US008015968B2

(12) United States Patent
Christ

(10) Patent No.: US 8,015,968 B2
(45) Date of Patent: Sep. 13, 2011

(54) THROWING DEVICE

(75) Inventor: David R. Christ, Cotter, AK (US)

(73) Assignee: Core Distribution, Inc., Minneapolis, MN (US)

( * ) Notice: Subject to any disclaimer, the term of this patent is extended or adjusted under 35 U.S.C. 154(b) by 700 days.

(21) Appl. No.: 11/943,767

(22) Filed: Nov. 21, 2007

(65) Prior Publication Data

US 2008/0127955 A1 Jun. 5, 2008

Related U.S. Application Data

(60) Provisional application No. 60/868,000, filed on Nov. 30, 2006.

(51) Int. Cl.
*F41B 3/04* (2006.01)

(52) U.S. Cl. ..... 124/5

(58) Field of Classification Search ..... 124/5, 6, 124/7, 8

See application file for complete search history.

(56) References Cited

U.S. PATENT DOCUMENTS

| | | | | | |
|---|---|---|---|---|---|
| 1,186,098 | A * | 6/1916 | Horst | 124/5 |
| 1,865,173 | A * | 6/1932 | Dickerman | 124/5 |
| 3,115,129 | A | 12/1963 | Merriman | |
| 3,901,208 | A * | 8/1975 | Laporte et al. | 124/5 |
| 4,076,004 | A * | 2/1978 | Huelskamp | 124/5 |
| 4,302,017 | A | 11/1981 | Huqueriza | |
| 4,548,413 | A * | 10/1985 | David | 473/173 |
| 4,595,205 | A | 6/1986 | Ruperto | |
| 4,872,688 | A * | 10/1989 | Galvin | 473/509 |
| 4,974,574 | A * | 12/1990 | Cutlip | 124/5 |
| 5,537,985 | A * | 7/1996 | Kohl | 124/5 |
| 5,579,748 | A * | 12/1996 | Kohl | 124/5 |
| 6,076,829 | A | 6/2000 | Oblack | |
| 7,665,454 | B1 * | 2/2010 | D'Agostino | 124/5 |

* cited by examiner

*Primary Examiner* — John Ricci
(74) *Attorney, Agent, or Firm* — Fredrikson & Byron, P.A.

(57) ABSTRACT

A throwing device includes an approximately straight and elongate shaft extending distally from a proximal end thereof to a distal portion of the device. The distal portion includes projectile retainer and a projectile track extending distally from the retainer to a distal tip of the device. The projectile retainer, when in a closed position, holds a projectile in a fixed position with respect to the device. When the shaft is gripped and swung through an arc, and the retainer opens to release the projectile, the projectile is propelled along the projectile track, by the swinging motion.

18 Claims, 3 Drawing Sheets

THROWING DEVICE

PRIORITY CLAIM

The present application claims priority to provisional application Ser. No. 60/868,000, which was filed on Nov. 30, 2006, and which is hereby incorporated, by reference, in its entirety.

TECHNICAL FIELD

The present invention pertains to handheld tools, or implements, and more particularly to devices that facilitate throwing a projectile.

BACKGROUND

Many handheld devices for assisting a person in throwing a generally spherical object are known in the art. Examples of some such devices include lacrosse sticks and jai alai cestas. However there is still a need for a throwing device having features allowing a person to expend minimal effort, for example, either in immediate exertion when, or in training to develop special skill prior to, throwing an object along a relatively long straight-line trajectory at a relatively high velocity. Such a device may be employed for utilitarian or recreational purposes.

SUMMARY

A throwing device, according to embodiments of the present invention includes an elongate shaft extending distally, in a relatively straight line, from a proximal end to a distal portion; the distal portion includes a projectile retainer and a projectile track, extending distally from the retainer to a distal tip of the device. The retainer reversibly grasps a projectile, for example by a spring force, until the shaft is swung to throw the projectile; preferably, the initiation of the swinging motion causes the retainer to release the projectile, for example by opening the retainer against the spring force, thereby allowing the swinging motion to propel the projectile along the track, toward the distal tip, and into the air. According to preferred embodiments, the track includes a pair of spaced apart rails and extends through an arc in proximity to the distal tip. Preferably, an interface between the projectile and a surface of the track has a coefficient of friction sufficient to impart a spin to the projectile as the projectile travels along the track.

BRIEF DESCRIPTION OF THE DRAWINGS

The following drawings are illustrative of particular embodiments and therefore do not limit the scope of the invention. The drawings are not to scale (unless so stated) and are intended for use in conjunction with the explanations in the following detailed description. Embodiments of the present disclosure will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides practical illustrations for implementing exemplary embodiments. Examples of constructions, materials, dimensions, and manufacturing processes are provided for selected elements, and all other elements employ that which is known to those of skill in the field of the invention. Utilizing the teaching provided herein, those skilled in the art will recognize that many of the examples have suitable alternatives that can be utilized.

Figure 1:
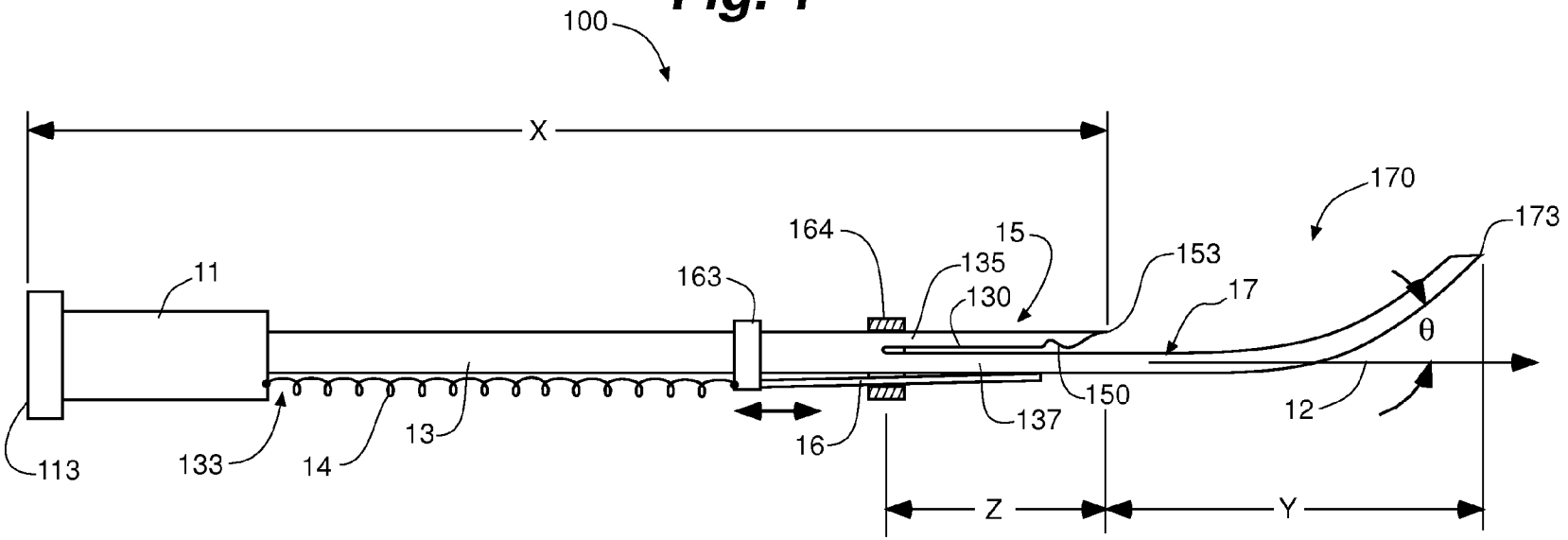
FIG. 1 is a plan view of a throwing device, according to some embodiments of the present invention.
Figure 2:
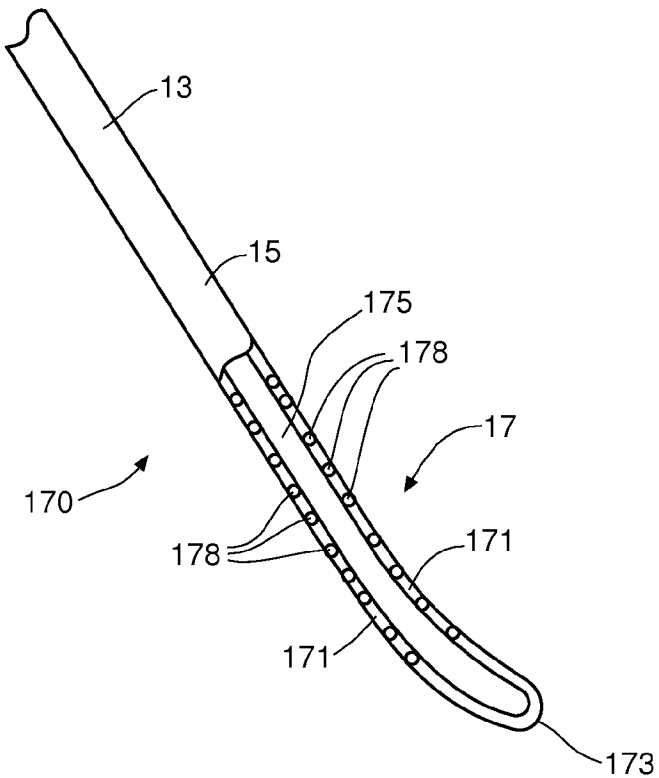
FIG. 2 is a perspective view of a distal portion of the device shown in FIG. 1, according to some embodiments.

FIG. 1 is a plan view of a throwing device 100, according to some embodiments of the present invention. FIG. 1 illustrates device 100 including an approximately straight elongate shaft 13 extending distally from a proximal end 133 to which a handle or gripping portion 11 is joined. Gripping portion 11 may be weighted in proximity to a proximal end 113 thereof, for example, either by a weight attached to proximal end 113, or by a weight, such as a steel rod, inserted within an interior of gripping portion 11. It should be noted that gripping portion 11 may be located more distally along shaft 13, spaced apart from proximal end 113, according to alternate embodiments. FIG. 1 further illustrates a distal portion 170 of device 100 extending distally from shaft 13, through an arc, to a distal tip 173 of device 100; distal portion 170 includes a projectile retainer 15 and a projectile track 17. FIG. 2 is a perspective view of device distal portion 170 wherein track 17 is shown as a pair of spaced apart rails 171 formed by edges of a grooved sidewall 175. According to the illustrated embodiment, distal portion 170 is integrally formed with shaft 13, being an extension thereof; and shaft 13, which is illustrated as a tubular member, has a distal segment cut therefrom to form track 17.

With further reference to FIG. 1, it may be appreciated that a slit 130 separates a first side 135 of shaft 13 from a second side 137 of shaft 13 to form retainer 15, and that second side 137 of shaft extends distally from retainer 15 as track 17. Closed and opened positions of retainer 15, for example, facilitated by slit 130, will be described in conjunction with FIGS. 3 and 4A. FIG. 1 further illustrates, in cross-section, an optional fixed collar 164 extending about shaft 13 at a stress concentration point created by slit 130. Optional collar 164 provides additional support to prevent slit 130 from opening more than is necessary. According to one exemplary embodiment, shaft 13 is a polycarbonate tube having an inner diameter (ID) of approximately ½ inch and an outer diameter (OD) of approximately ⅝ inch. It should be understood that the present invention is not limited to the illustrated construction, and any construction that provides a pair of rails for a projectile track extending from a projectile retainer, which is coupled to an elongate shaft, may be employed by alternate embodiments.

Figure 3:
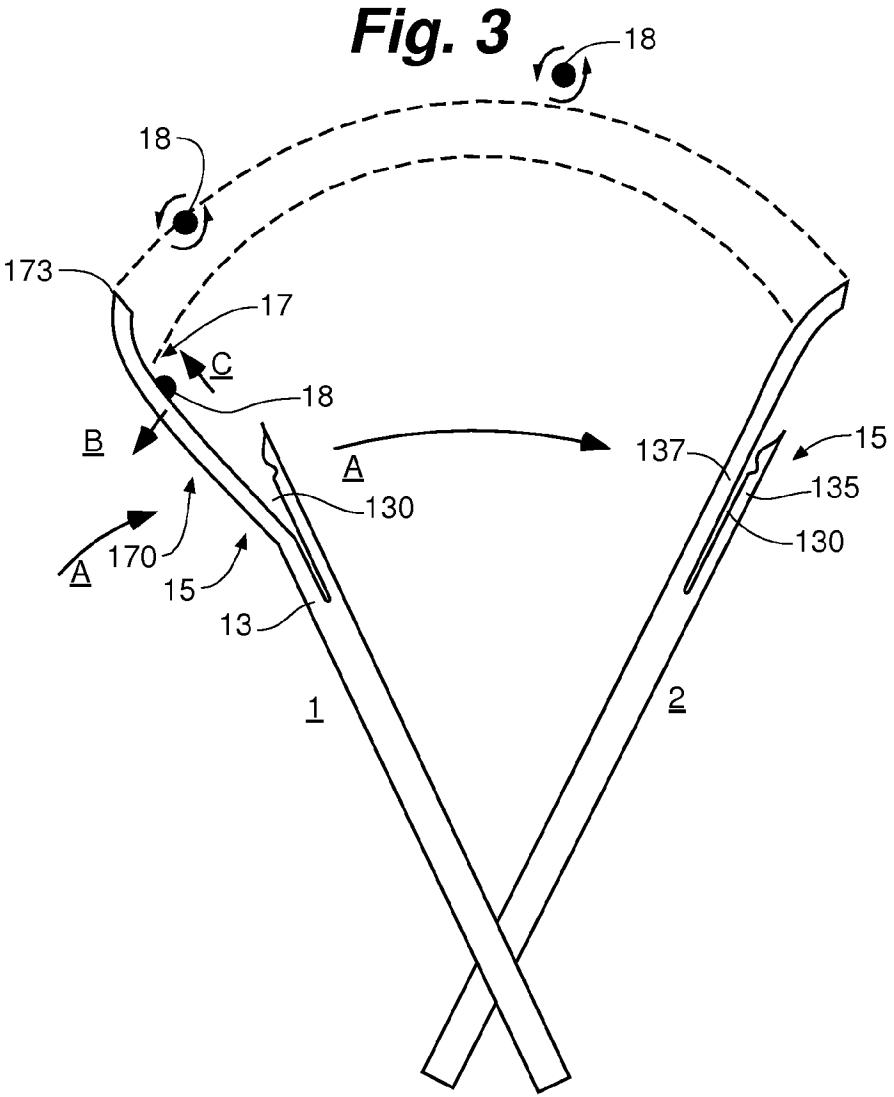
FIG. 3 is a schematic of the device of FIG. 1, which shows the device in a first position and a second position of a swinging motion, according to some embodiments of the present invention.

FIG. 3 is a schematic of device 100 in a first position 1 and in a second position 2 of a swinging motion generally defined by arrow A. With reference to FIGS. 1 and 3, it may be appreciated that first and second sides 135, 137 of shaft 13, which form retainer 15, act like a spring clamp to hold a projectile 18 in a fixed position, in proximity to a distal end 153 of retainer 15, until the swinging motion is initiated to open retainer 15. FIG. 3 illustrates initiation of the swinging motion, at position 1, whereby shaft second side 137 bends away from shaft first side 135, per arrow B, to open retainer 15 and, thereby, release projectile 18 from retainer 15 to be propelled along track 17 per arrow C. Although intermediate positions of device 100, between positions 1 and 2, are not shown, it should be appreciated that, as device 100 is swung, per arrow A, second side 137 'springs' back toward first side 135 as projectile 18 travels toward distal tip 173, accelerating along the arc or curvature of track 17, to be launched from device 100. At the end of the swinging motion, for example, at position 2, shaft second side 137 has sprung back alongside first side 135. According to exemplary embodiments of the present invention, shaft 13 is formed of a relatively stiff yet resilient material, for example, polycarbonate, nylon, acrylic, or polypropylene plastic, which inherently provides the spring properties necessary for retainer 15 to both hold and release projectile 18, and for second side 137 to spring back, as described.

According to some alternate embodiments of the present invention, second side 137 of retainer is supported by a back member 16 shown in FIG. 1. FIG. 1 illustrates the optional back member 16 attached to shaft 13 by a collar 163. Back member 16, being relatively stiff, yet resilient, may be employed to stiffen shaft second side 137, and may be adjustable, for example, by moving collar 163 along shaft 13, per the double-headed arrow, to provide variable stiffness. According to some embodiments of the present invention, collar 163 is attached to gripping portion 11 via a spring 14 (shown with dashed lines in FIG. 1). Spring 14 may be compressed to bring collar 163 and back member 16 into close proximity with gripping portion 11; at the start of a swing, spring 14 may be released to force collar 163 and back member 16 into the illustrated position, thereby providing additional 'snap' or acceleration to the 'spring back' of second side 137, after projectile 18 is released from retainer 15, in order to increase an acceleration of projectile 18 along track 17.

With further reference to FIG. 1, a length X of device 100, from proximal end 113 of gripping portion 11 to distal end 153 of retainer 15, may be between approximately 30 inches and approximately 50 inches, an angle θ defining the arc of track 17, may be between approximately 10° and 45°, with respect to a longitudinal axis 12 of shaft 13, a length Y, over which track 17 extends, projected onto axis 12, may be between approximately 8 inches and approximately 14 inches, and a length Z, defining an extent of slit 130, may be between approximately 3 inches and approximately 6 inches. According to an aforementioned exemplary embodiment, wherein shaft 13 is made from a ½ inch ID and ⅝ inch OD polycarbonate tube, length Y is preferably approximately 12 inches, length Z is preferably approximately 4 inches, and angle θ is approximately 20°.

Turning back to FIG. 3, arrows about launched projectile 18 indicate a spinning motion, which may be imparted to projectile 18 via travel along track 17. According to preferred embodiments of the present invention, an interface between track 17 and projectile 18 provides a sufficient coefficient of friction between projectile and track to impart the spinning motion to projectile 18; the spinning motion can generate greater stability and aerodynamic lift to keep projectile 18 traveling in a straight-line trajectory over a greater distance. Such an interface may be provided by inherent surface properties of track 17 and/or projectile 18, by a tacky layer applied to track 17 and/or projectile 18, or by a surface roughness imparted to track 17 and/or projectile 18. With reference back to FIG. 2, according some exemplary embodiments of the present invention, silicone rubber beads 178 are adhered to a surface of track 17 in order to provide such an interface; according to some alternate exemplary embodiments, a silicone rubber material, or any other relatively tacky material, may be applied as a continuous strip along track 17; such a strip may extend from edges, or rails 171, along inner surface of grooved sidewall 175 to increase ease of manufacturing and/or to enhance a durability thereof, and may be applied as a tape or insert molded onto device 100.

Figure 4A:
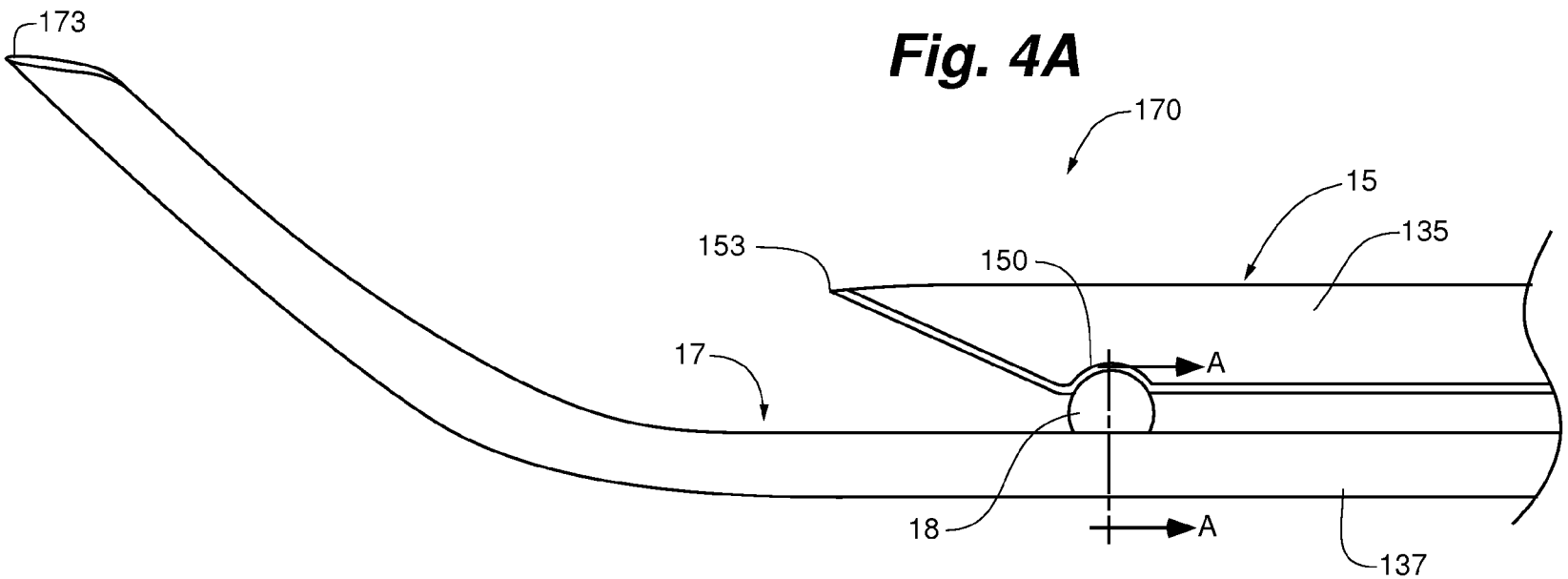
FIG. 4A is a side plan view of the distal portion of the device shown in FIG. 1, according to some embodiments.
Figure 4B:
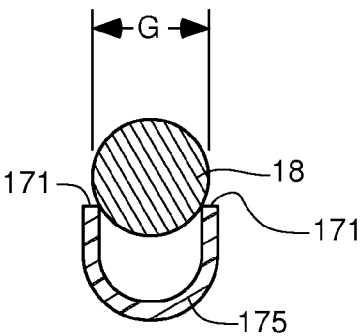
FIG. 4B is a section view through line A-A of FIG. 4A, according to some embodiments.

According to the illustrated embodiment, as projectile 18, which is, preferably, generally spherical, rolls along track 17, projectile 18 only contacts rails 171, for example, as is illustrated in FIG. 4B. FIG. 4B is a section view through line A-A of FIG. 4A, according to some embodiments, and FIG. 4A is a side plan view of distal portion 170 of device 100. A starting point of track 17 coincides with the location of projectile 18 when held by retainer 15, as illustrated in FIG. 4A, and FIG. 4B illustrates rails 171 of track 17 as previously-described edges of grooved sidewall 175, which edges are spaced apart by a gap G. The wider gap G between rails 171, for a given diameter of projectile 18, translates into a higher spin velocity for the projectile. FIG. 4A further illustrates retainer 15 including an optional aperture 150, which is located in proximity to distal end 153 thereof, to facilitate loading of projectile 18 therein, between sides 135, 137.

In the foregoing detailed description, the invention has been described with reference to specific embodiments. However, it may be appreciated that various modifications and changes can be made without departing from the scope of the invention as set forth in the appended claims. For example, a projectile retainer, according to some alternate embodiments, may be actuated to open and close independent of the previously-described swinging motion, for example, via a push button actuated spring-loaded jaw member.

I claim:

1. A throwing device comprising:

a distal tip;

a distal portion extending proximally from the distal tip, the distal portion including a projectile retainer and a projectile track, the track extending distally from the retainer to the distal tip and extending in an arc in proximity to the distal tip, and the retainer having a closed position, wherein a projectile is held by the retainer in a fixed position with respect to the device, and an open position, wherein the projectile is released by the retainer to travel along the track; and an elongate and approximately straight shaft extending proximally from the distal portion, wherein the projectile track comprises a pair of spaced apart rails, and wherein the rails are formed by edges of a grooved sidewall.

2. The device of claim 1, further comprising:

a gripping portion; and wherein the shaft includes a proximal end and the gripping portion is located in proximity to the proximal end; and the retainer is moved from the closed position to the open position by gripping the gripping portion of the device and then swinging the distal tip of the device through an arc.

3. The device of claim 1, wherein a spring force maintains the projectile retainer in the closed position.

4. The device of claim 1, wherein the projectile track comprises a tacky surface to interface with the projectile.

5. The device of claim 1, wherein an angle defining the arc in which the projectile track extends is between approximately 10 degrees and approximately 45 degrees with respect to a longitudinal axis of the shaft, and a length over which the projectile track extends, projected onto the longitudinal axis of the shaft, is between approximately 8 inches and approximately 14 inches.

6. A throwing device comprising:

a distal tip;

a distal portion extending proximally from the distal tip, the distal portion including a projectile retainer and a projectile track, the track extending distally from the retainer to the distal tip and extending in an arc in proximity to the distal tip, and the retainer having a closed position, wherein a projectile is held by the retainer in a fixed position with respect to the device, and an open position, wherein the projectile is released by the retainer to travel along the track;

an elongate and approximately straight shaft extending proximally from the distal portion, wherein the shaft and the distal portion of the device are integrally formed from a tubular member.

7. The device of claim 6, further comprising:

a gripping portion; and wherein the shaft includes a proximal end and the gripping portion is located in proximity to the proximal end and the gripping portion is weighted.

8. A throwing device comprising:

a distal tip;

a distal portion extending proximally from the distal tip, the distal portion including a projectile retainer and a projectile track, the track extending distally from the retainer to the distal tip and extending in an arc in proximity to the distal tip, and the retainer having a closed position, wherein a projectile is held by the retainer in a fixed position with respect to the device, and an open position, wherein the projectile is released by the retainer to travel along the track;

an elongate and approximately straight shaft extending proximally from the distal portion, wherein the distal portion comprises a tubular member including a first side, a second side and a longitudinal slit separating the first side from the second side;

the first side terminating at a distal end of the projectile retainer and the first side, in conjunction with the second side, forming the projectile retainer, and the second side terminating at the distal end of the device and the second side forming the projectile track.

9. The device of claim 8, wherein the longitudinal slit has a length between approximately 3 inches and approximately 6 inches.

10. The device of claim 8, further comprising a back member attached to the shaft and extending alongside the slit to add stiffness to the second side.

11. The device of claim 10, wherein the back member is slidably engaged with the shaft to provide adjustable stiffness to the second side.

12. The device of claim 11, wherein the back member is spring-loaded.

13. A method for throwing a projectile with a throwing device, the method comprising:

positioning the projectile between opposing first and second sides of an elongate and approximately straight shaft of the throwing device such that the projectile is held in a fixed position with respect to the throwing device, the first and second sides being separated by a slit and the second side of the shaft extending distally, from the position at which the projectile is held, to form a projectile track;

gripping the elongate and approximately straight shaft of the throwing device, the shaft extending proximally from the position at which the projectile is held; and swinging the shaft through an arc to cause the second side of the shaft to bend away from the first side, thereby releasing the projectile from the fixed position, and to propel the projectile along the projectile track of the device, the projectile track extending in an arc in proximity to a distal tip of the device.

14. The method of claim 13, wherein positioning comprises inserting the projectile through an aperture formed in at least one of the opposing sides in order to position the projectile between the opposing sides of the shaft.

15. The method of claim 13, further comprising adjusting a stiffness of the second side of the shaft.

16. The method of claim 13, further comprising:

spring-loading a back member prior to swinging the shaft; and releasing the back member in conjunction with swinging the shaft;

wherein the back member is attached to the shaft and is slidably engaged with the shaft so that when the back member is released the back member slides distally to change a stiffness of the second side of the shaft.

17. A method for throwing a projectile with a throwing device, the method comprising:

positioning the projectile in a projectile retainer of the throwing device such that opposing sides of the retainer holds exert a spring force operative to hold the projectile in a fixed position with respect to the throwing device;

gripping an elongate and approximately straight shaft of the throwing device, the shaft extending proximally from the projectile retainer; and swinging the shaft through an arc to open the projectile retainer and to propel the projectile from the opened retainer along a projectile track of the device, the projectile track extending distally from the projectile retainer and in an arc in proximity to a distal tip of the device;

wherein positioning comprises inserting the projectile between the opposing sides of the retainer by inserting the projectile through an aperture formed in at least one of the opposing sides; and adjusting a stiffness of one of the opposing sides of the projectile retainer; and wherein the one of the opposing sides of the retainer extends distally from the retainer to form the track.

18. The method of claim 17, further comprising:

spring-loading a back member prior to swinging the shaft;

releasing the back member in conjunction with swinging the shaft; and wherein the back member is attached to the shaft and is slidably engaged with the shaft so that when the back member is released the back member slides distally to change a stiffness of one of the opposing sides of the projectile retainer.

* * * * *